US006116061A

United States Patent [19]

Oh et al.

[11] Patent Number: 6,116,061

[45] Date of Patent: Sep. 12, 2000

[54] FILTERING TYPE WASHING MACHINE

[75] Inventors: Dong Yeop Oh, Kyungki-do; Kyeong Hwan Kim, Seoul, both of Rep. of Korea

[73] Assignee: LG Electronics Inc., Seoul, Rep. of Korea

[21] Appl. No.: 08/984,025

[22] Filed: Dec. 3, 1997

[30] Foreign Application Priority Data

Dec. 18, 1996 [KR] Rep. of Korea ..... 96 67419

[51] Int. Cl.[7] ..... D06F 21/08

[52] U.S. Cl. ..... 68/23.5; 68/53; 68/148; 68/174; 68/184

[58] Field of Search ..... 68/53, 18 D, 23.5, 68/184, 148, 171, 174

[56] References Cited

U.S. PATENT DOCUMENTS

| | | | |
|---|---|---|---|
| 1,832,560 | 11/1931 | Kendig | 68/148 X |
| 2,502,965 | 4/1950 | Knapp | 68/53 X |
| 2,561,257 | 7/1951 | Woodson | 68/23.5 X |
| 2,621,505 | 12/1952 | Smith | 68/23.5 X |
| 3,367,153 | 2/1968 | Brubaker et al. | 68/23.5 X |
| 3,384,909 | 5/1968 | Scott | 68/23.5 X |
| 4,987,627 | 1/1991 | Cur et al. | 68/148 X |

FOREIGN PATENT DOCUMENTS

| | | | |
|---|---|---|---|
| 330937 | 12/1920 | Germany | 68/148 |
| 46199 | 11/1984 | Japan | 68/53 |
| 142894 | 7/1985 | Japan | 68/53 |
| 44960 | 10/1985 | Japan | 68/53 |
| 24210 | 10/1910 | United Kingdom | 68/148 |

*Primary Examiner*—Philip R. Coe
*Attorney, Agent, or Firm*—Fleshner & Kim, LLP

[57] ABSTRACT

A washing machine includes an outer tub, an inner tub, fluid nozzle configured to spray fluid into the inner tub, a fluid pump, and a controller. The washing machine may also include a pulsator located in the inner tub for applying a force to clothing in inner tub. During a first washing cycle, the controller causes the inner tub to rotate, and the nozzle to spray fluid onto clothing in the inner tub. During the first washing cycle, a fluid level in the outer tub may be controlled so that it is lower than the inner tub. During a second washing cycle, the inner tub is held stationary, and the pulsator applies a force to clothing in the inner tub, as occurs in conventional washing machines. Because the fluid level in the washing machine can be kept quite low during the first washing cycle, less water and less detergent is required. Also, because the level of the water is kept below the rotating inner tub during the first washing cycle, less force and thus less energy are required to rotate the inner tub.

15 Claims, 5 Drawing Sheets

FILTERING TYPE WASHING MACHINE

BACKGROUND OF THE INVENTION

1. Field of the Invention

The present invention relates to a washing machine, and more particularly, to a filtering type washing machine in which water is made to filter through laundry for washing the laundry.

2. Discussion of the Related Art

Being a device for stripping contaminants from the laundry by applying energy, such as impact, there are in general pulsator washing machines, drum washing machines, and agitator washing machines according to the way of application of energy to the laundry. That is, washing is done either by applying impact to the laundry with a pulsator or agitator (washing rod) or by dropping the laundry to give impact to the laundry.

FIG. 1 illustrates a cross section of a conventional pulsator type washing machine, referring to which the conventional pulsator type washing machine will be explained.

The conventional pulsator type washing machine is provided with a washing machine case 1, an outer tub 2 suspended from the case 1 with a damper assembly 9, an inner tub(combined washing and drying tub) 3 rotatably fitted in the outer tub 2, and a pulsator 4 rotatably fitted at a center of a bottom of the inner tub 3. Driving means is fitted under the outer tub 2 for driving the inner tub 3 and the pulsator 4, including a combined washing and drying motor 8, a clutch mechanism 7, and a power transmission mechanism for transmitting torque of the motor 8 to the clutch mechanism 7, i.e., a belt 5. The clutch mechanism 7 is provided with a clutch spring, a brake drum, and a speed reduction mechanism therein, and the inner tub 3 and the pulsator 4 is coupled to an output shaft 6 on the clutch mechanism 7.

The operation of the aforementioned pulsator type washing machine will be explained.

There are at large a washing cycle, a rinsing cycle, and a drying cycle in the operation of the washing machine, executed in the aforementioned order. In the washing cycle, torque of the motor 8 is transmitted to the clutch mechanism 7 through the belt 5, and the clutch mechanism 7 reduces a rotational speed received from the motor 8 and rotates the pulsator 4 in regular/reverse direction intermittently. The repeated intermittent rotation of the pulsator 4 in regular/reverse direction causes the laundry in the inner tub 3 to rotate and water to circulate. Thus, the laundry is washed by the impact from the pulsator 4, the friction with the water circulation and the inner tub 3 and the softening action of detergent. After carrying out the washing cycle for a duration, a drain valve 10 is opened to discharge used water to outside of the washing machine. Then, after supplying new water into the inner tub 3, the pulsator 4 is rotated for carrying out the rinsing cycle for a preset number of times. Upon completion of the rinsing cycle, a clutch spring in the clutch mechanism 7 is changed over to leave the pulsator 4 stationary and rotate the inner tub 3 at a high speed, to carry out the drying cycle, at the end of which the operation of the washing machine ends.

However, the conventional washing machine has the following problems.

First, in the conventional washing machine, in most cases, a mechanical energy, such as torque of a pulsator is applied to laundry and water for washing the laundry. Therefore, in order to satisfy a required degree of washing, a torque over a preset level is required, which causes tangling of, or damage to the laundry.

Second, in the conventional washing machine, the operation of the washing machine with the inner tub and outer tub tilled with water leads to consume much water and as the filled water increases, the amount of detergent to be added is increased.

Third, the consequential increase of water supply and discharge time results in a longer washing time.

SUMMARY OF THE INVENTION

Accordingly, the present invention is directed to a filtering type washing machine that substantially obviates one or more of the problems due to limitations and disadvantages of the related art.

An object of the present invention is to provide a washing machine which can prevent tangling of and damage to laundry in washing.

Another object of the present invention is to provide a washing machine which can reduce consumption of water and detergent in washing.

Other object of the present invention is to provide a washing machine which can shorten a washing time.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the filtering type washing machine includes water supplying means for pumping water from an outer tub to spray to a laundry in an inner tub, and water storing means formed in a bottom of the outer tub for storing the water and providing the stored water to the water supplying means.

Preferably, the filtering type washing machine further includes a pulsator rotatably fitted inside of the inner tub for generating a mechanical torque.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
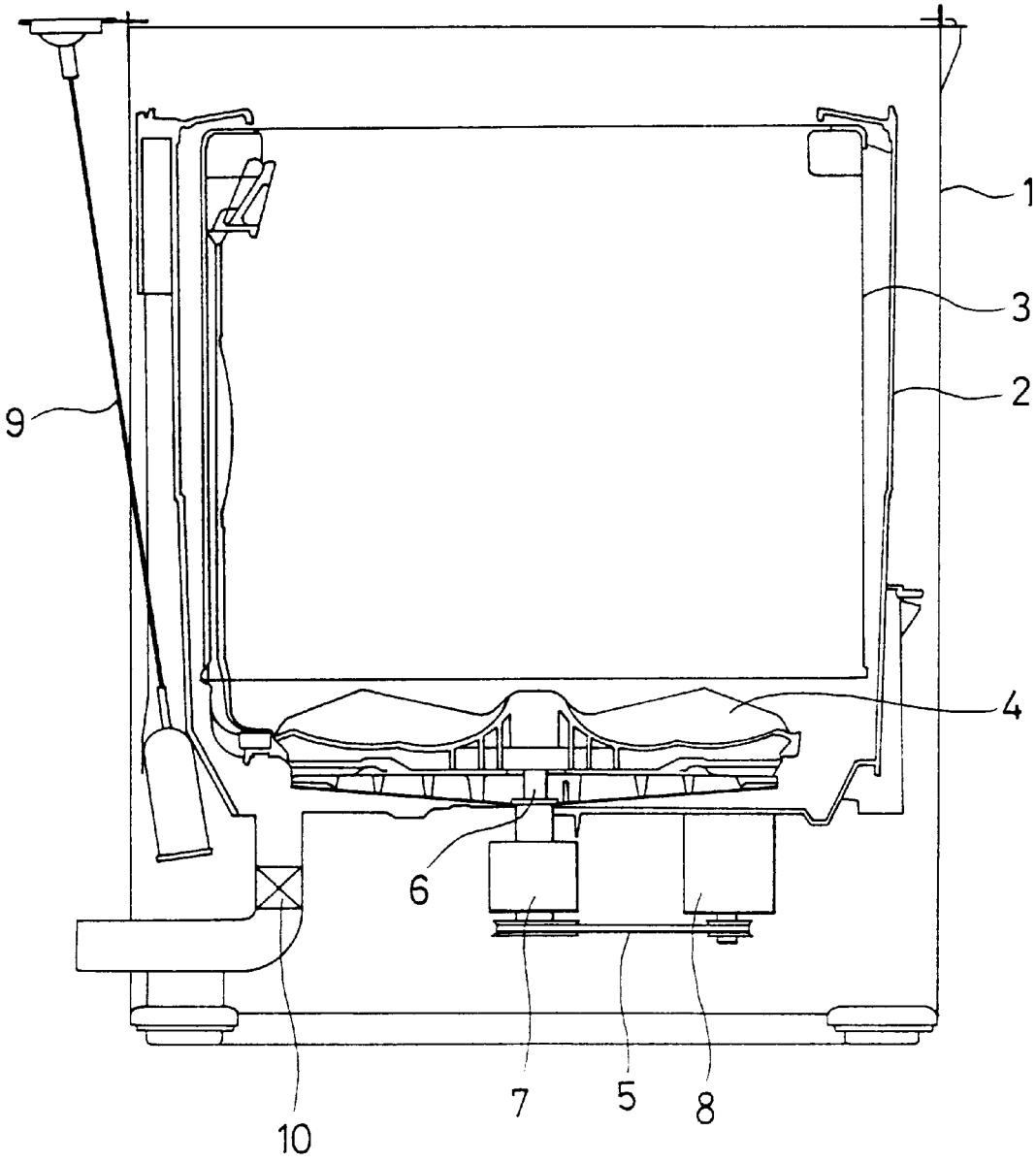
FIG. 1 PRIOR ART
FIG. 1 illustrates a cross section of a conventional pulsator type washing machine.
Figure 2:
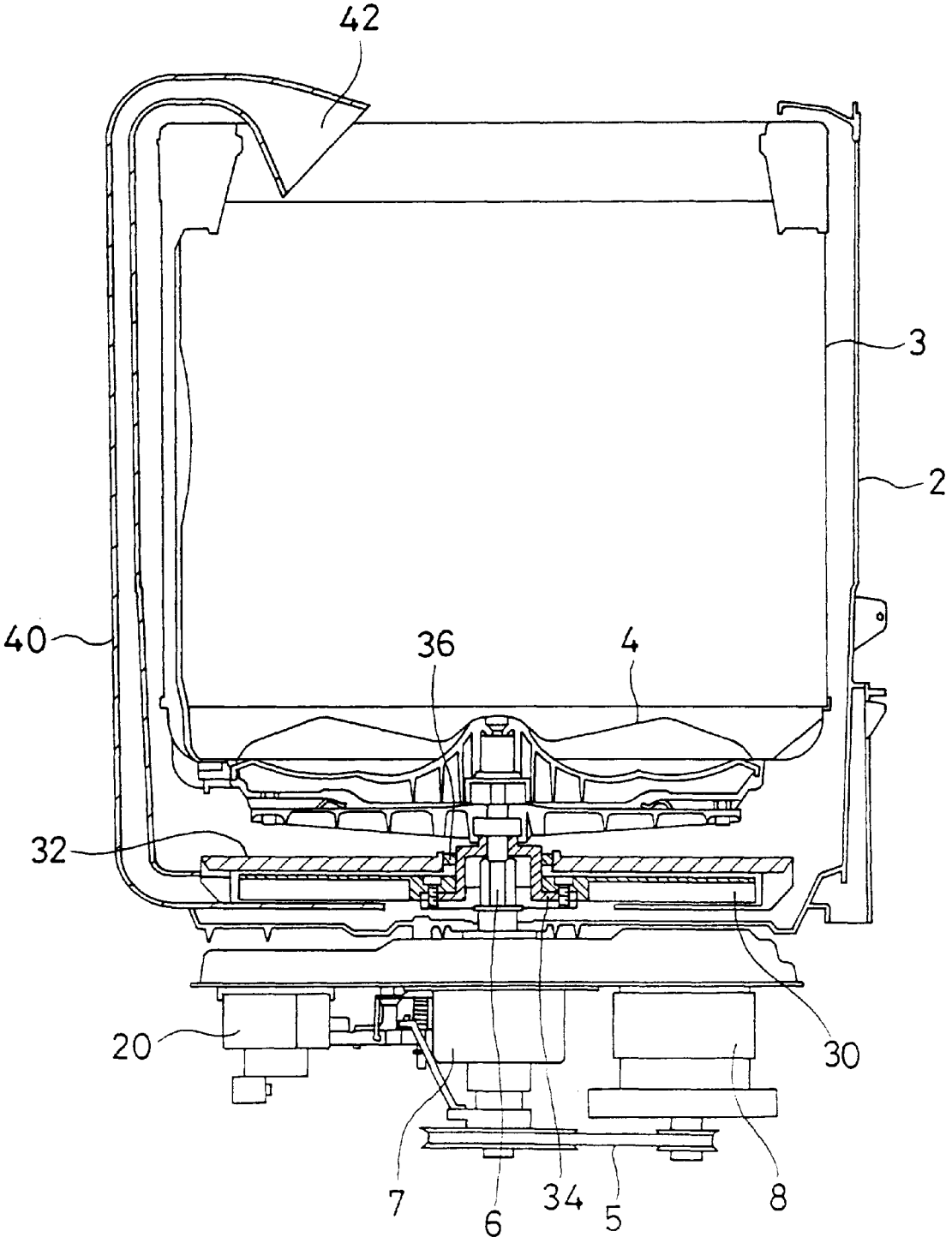
FIG. 2 illustrates a front view of a filtering type washing machine in accordance with a preferred embodiment of the present invention.
Figure 3:
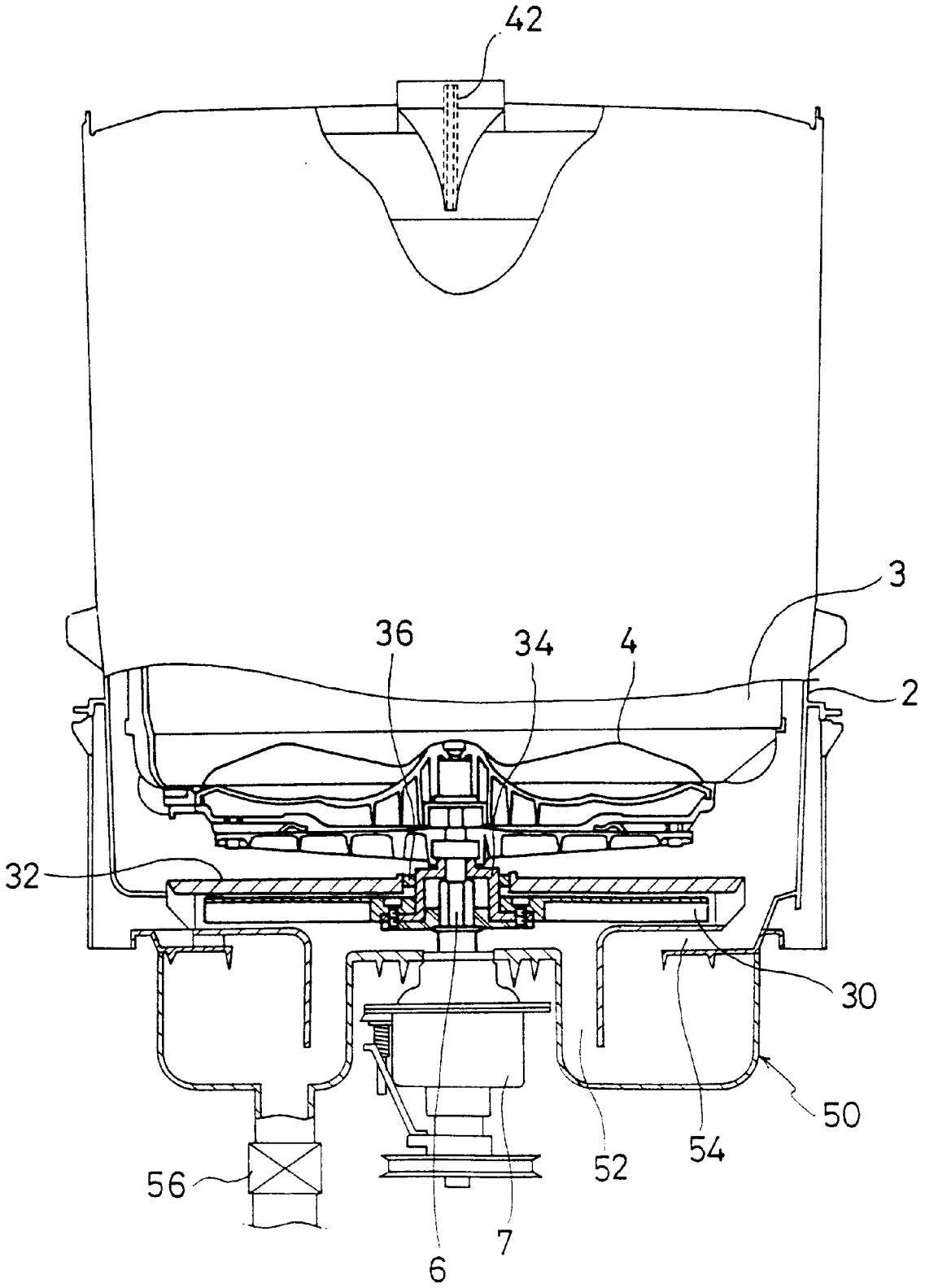
FIG. 3 illustrates a side view of a filtering type washing machine in accordance with a preferred embodiment of the present invention.

Reference will now be made in detail to the preferred embodiments of the present invention, examples of which are illustrated in the accompanying drawings. FIG. 2 illustrates a front view of a filtering type washing machine in accordance with a preferred embodiment of the present invention, and FIG. 3 illustrates a side view of a filtering type washing machine in accordance with a preferred embodiment of the present invention. The same reference numbers will be used for components of the present invention identical to the conventional one, and explanations on the identical components will be omitted, accordingly.

The filtering type washing machine is provided with water supplying means for pumping water from between an inner tub 3 and an outer tub 2 into an inner tub through an upper part thereof, and water storing means formed on a bottom of the outer tub 2 for storing the water. Besides, alike the conventional washing machine, the filter type washing machine is also provided with an outer tub 2, an inner tub 3, a pulsator 4, a motor 8, a clutch mechanism 7 and a drain motor 20. The drain motor 20, operative in a first and a second stages, connects/disconnects a brake drum in the clutch mechanism 7. That is, the brake drum is released in the first stage operation to transmit torque, and in the second stage operation, the operation of the first stage as well as opening of the drain valve 56 are conducted.

The water supplying means will be explained in detail.

The water supplying means is provided with a rotating blade 30 on a rotating shaft 6 in the clutch mechanism 7, a casing 32 enclosing the rotating blade 30, a water passage 40 for guiding pumped water to an upper part of the inner tub 3, and a nozzle 42 at an end of the water passage 40. The nozzle 42 is preferably enlarged toward an end thereof for spraying the water into the inner tub 3 evenly in a radial direction. The rotating blade 30 is preferably fitted to the rotating shaft 6 with a retainer 34 inbetween. The rotating blade 30 and the casing 32 are provided between bottoms of the inner tub 3 and the outer tub 2, spaced from the bottom of the outer tub 2 for a certain distance. A sealing means, such as a sealer 36, is preferably provided at an upper center part of the casing 32 for preventing both reduction in a pumping efficiency and formation of foam caused by air infiltering thereto.

If a water level is kept low during, filtering washing of the washing machine, an increase of load coming from contact of the foam with the inner tub 3 can be prevented. Therefore, the filtering type washing machine of the present invention is provided with the water supplying means disposed at a position lower than bottom of the outer tub 2 for storing water. The water storing means is provided with a water storage tank 50 with an inlet 52 and an outlet 54, and a drain valve 56 connected to the water storage tank 50. The water storage tank 50 is formed by forming a bottom portion of the outer tub 2 lower than the bottom of the outer tub 2 excluding portions at which the clutch mechanism 7, the motor, and the like are fitted.

Figure 5:
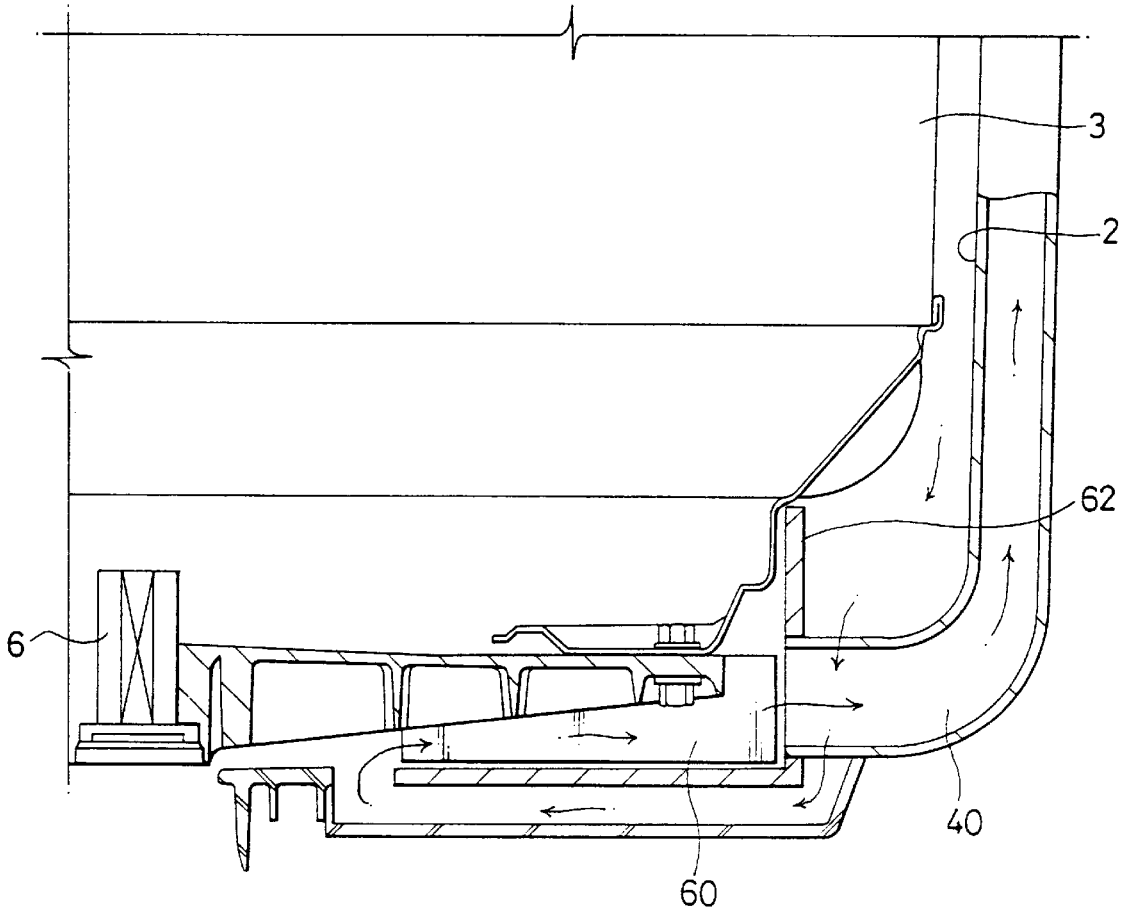
FIG. 5 illustrates a section showing another embodiment of the present invention.

In the aforementioned embodiment, though the case in which a pumping is done by using the rotating blade 30 and the casing 32 is explained, the present invention will not be limited to this case. For example, as shown in FIG. 5, the pumping configuration may be simplified by providing a plurality of blades 60 each projected from an under side of the inner tub 3 downwardly in place of the rotating blade 30 in the water supplying means and, in addition, a guide 62 projected from the bottom of the outer tub 2 upwardly for providing a circulation resistance in a circumferential direction in place of the casing 32.

Figure 4:
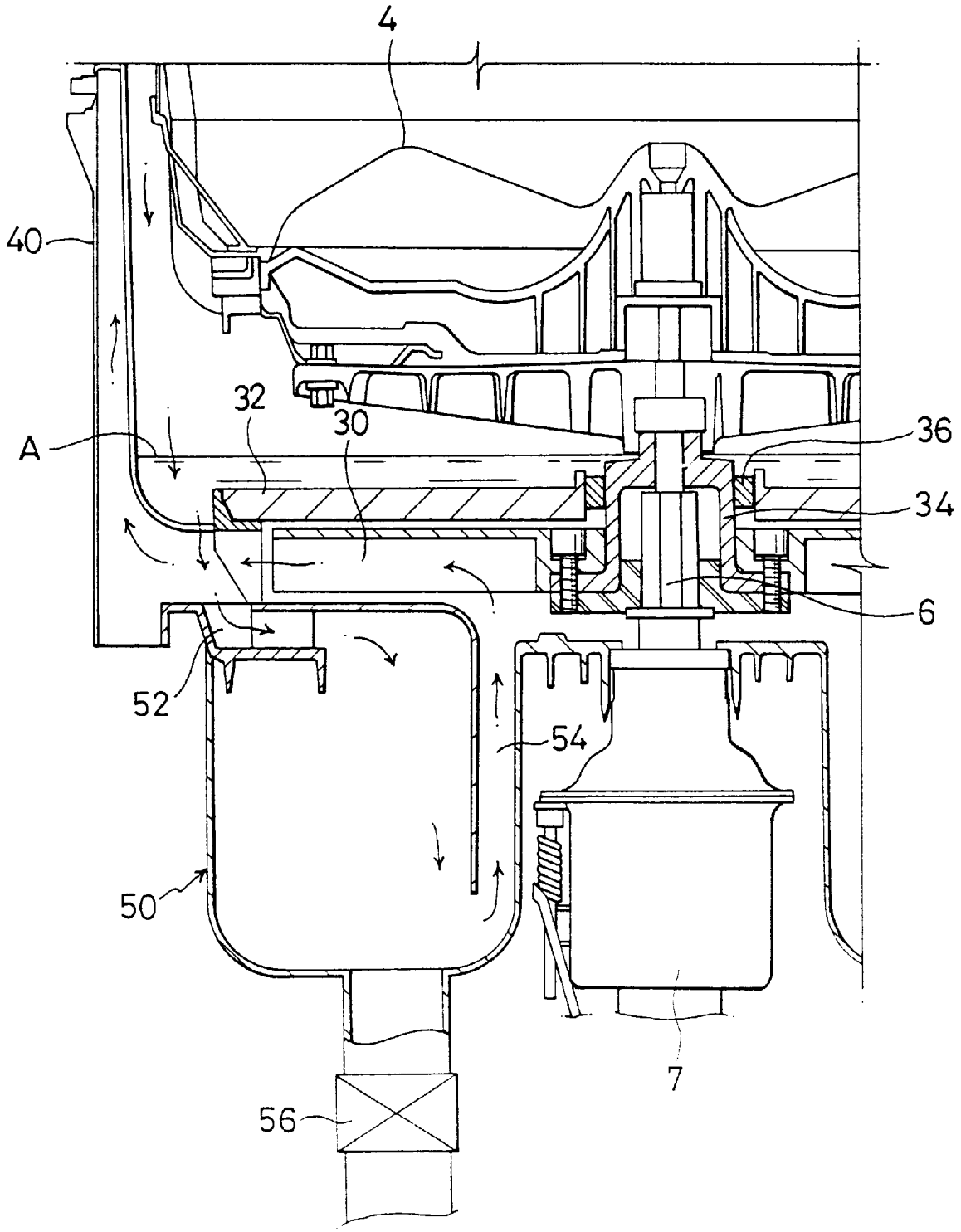
FIG. 4 illustrates an enlarged sectional view of a principal part of the present invention.

The function and advantages of the filtering type washing machine of the present invention will be explained with reference to FIG. 4.

In the case of washing, the torque from the motor is transmitted to the rotating shaft 6 via the clutch mechanism 7, according to which the pulsator 4, the inner tub 3 and the rotating blade 30, coupled to the rotating shaft 6, are rotated as one unit. That is, though the pulsator 4 only is rotated in a washing cycle of the conventional washing machine, the pulsator 4, the inner tub 3 and the rotating blade 30 are rotated as one unit in the present invention. In this instance, the drain motor 20 is of course at the first stage, leaving the brake drum rotatable. Accordingly, the water in the outer tub 2 is pumped by the centrifugal force produced by the rotation of the rotating blade 30, to flow along the water passage 40 toward the nozzle 42. The water pumped to the nozzle 42 thus is discharged to the laundry in the inner tub 3. The water discharged to the laundry is exerted of a centrifugal force in a radial direction, a rotational force in a circumferential direction and the gravity. If rotational speed of the inner tub 3 is changed, interaction between these forces is changed. That is, even if the sprayed water hits at a same position of the laundry, a path of the water until the water escapes from the inner tub 3 through the discharge holes in a side thereof can be changed. Therefore, by an appropriate change of the rotational speed of the inner tub 3, the water can be made to thread through every corners of the laundry to remove contaminants therefrom. In the meantime, the water escaped from the inner tub 3 through the discharge holes flows down along a wall of the outer tub 2 to fill in the water storage tank 50, which is then pumped again into the inner tub 3 by a drawing force of the rotating blade 30, to carry out the filtering washing. With the aforementioned series steps of process, the water filters through the laundry, washing the laundry. However, when there is a solid state contaminant between textures of the laundry which is not soluble in water or blocks water flowing therethrough, a perfect washing off of the contaminant by means of the filtering type washing is difficult. Accordingly, washing the laundry with the conventional pulsator 4 in addition to the filtering type washing is preferable. In this instance, since most of the contaminants are removed in the filtering washing, different from the conventional pulsator type washing, even a short time of this type washing with a mechanical energy can be sufficient enough. As an extent of the water level required for washing in the filtering type washing machine of the present invention is enough if the water level allows pumping by the water supplying means, the water level A is kept to an extent at which the casing is submerged in the water. Further, in the washing machine of the present invention having the water storage tank 50, the use of the same water in the washing by repeated pumping of the water from the storage tank 50 to the water passage 40 allows washing with a water level kept lower than the case of no water storage tank 50. In other words, a possible increase of load torque produced by contact of the water with the inner tub 3 can be prevented because of the water level being kept low during washing.

In the meantime, in the drying cycle, the drain motor 20 is set to the second stage, putting the brake drum in an rotatable state and opening the drain valve 56. Accordingly, the water staying in the laundry is extracted, collected in the storage tank 50 and drained through the drain valve 56.

In the washing machine of the present invention, there are two stages of rinsing cycle; one is a pumping shower rinsing cycle and the other is water supplying shower rinsing cycle. First, in the pumping shower rinsing cycle, the drain motor 20 is set to the first stage, putting the brake drum rotatable and closing the drain valve 56, to circulate the water in the same fashion as the aforementioned washing cycle, for carrying out a filtering rinsing. And, in the water supplying shower rinsing, the drain motor 20 is set to the second stage, putting the brake drum rotatable and opening the drain valve 56, for carrying out a filtering rinsing using the pumped water and draining the water through the drain valve 56 to outside of the washing machine. With the washing cycle, the rinsing cycle and the drying cycle thus done, the washing is completed.

As has been explained, the filtering type washing machine of the present invention has the following advantages.

First, the filtering type of washing in major part of the washing allows less movements of the laundry, that prevents the laundry from being tangled or damaged.

Second, the keeping of the water level low allows reduction of power consumption as well as reductions of water and detergent consumptions.

Third, the reduction in water supply and drain times which is nothing to do with the washing directly allows a reduction of an overall washing time.

It will be apparent to those skilled in the art that various modifications and variations can be made in the filtering type washing machine of the present invention without departing from the spirit or scope of the invention. Thus, it is intended that the present invention cover the modifications and variations of this invention provided they come within the scope of the appended claims and their equivalents.

What is claimed is:

1. A washing machine, comprising:

an outer tub;

an inner tub located inside the outer tub and configured to hold cloth;

fluid supplying means for pumping fluid from the outer tub such that the fluid is sprayed directly onto cloth in the inner tub; and fluid storing means, located at a bottom of the outer tub, for storing fluid and for providing the stored fluid to the fluid supplying means, wherein the washing machine is configured such that during a first washing cycle, the inner tub rotates, and fluid is sprayed directly onto cloth in the inner tub by the fluid supplying means, wherein the washing machine is configured to vary a rotational speed of the inner tub during the first washing cycle, and wherein varying the rotational speed of the inner tub causes the fluid to change a path it takes in passing through cloth in the inner tub.

2. The washing machine of claim 1, further comprising a pulsator located in the inner tub, wherein the pulsator is selectively activated.

3. The washing machine of claim 2, wherein the washing machine is configured such that during a second washing cycle, the pulsator is activated while the inner tub is held stationary.

4. The washing machine of claim 1, wherein the fluid storing means includes an inlet connected to the outer tub, and an outlet for supplying fluid to the fluid supplying means.

5. The washing machine of claim 4, further comprising a drain valve for draining fluid from the fluid storing means.

6. The washing machine of claim 1, wherein the fluid supplying means includes a fluid pump comprising:

a rotating blade;

a casing that at least partially encloses the rotating blade; and an outlet for supplying fluid.

7. The washing machine of claim 6, wherein the fluid pump further comprises an inlet for drawing fluid from the fluid storing means.

8. The washing machine of claim 6, wherein the rotating blade is attached to a bottom of the inner tub such that the rotating blade rotates with the inner tub.

9. The washing machine of claim 8, wherein the casing is attached to the outer tub.

10. The washing machine of claim 1, wherein the washing machine is configured such that during the first washing cycle, a fluid level within the outer tub is maintained below the inner tub.

11. A washing machine, comprising:

an outer tub;

an inner tub located inside the outer tub and configured to hold cloth;

a fluid supplying device that is configured to pump fluid from the outer tub such that the fluid is sprayed into the inner tub; and a fluid storage device that is configured to store fluid and to supply the stored fluid to the fluid supplying device, wherein the washing machine is configured such that during a first washing cycle, a fluid level in the outer tub is maintained below the inner tub, and such that a travel path of fluid sprayed into the inner tub by the fluid supplying device varies during the first washing cycle in response to changes in a rotational speed of the inner tub.

12. The washing machine of claim 11, further comprising a pulsator located in the inner tub, wherein the pulsator is selectively activated.

13. The washing machine of claim 12, wherein the washing machine is configured such that during the first washing cycle, the inner tub rotates, and such that during a second washing cycle, the pulsator is activated.

14. The washing machine of claim 13, wherein the washing machine is configured to hold the inner tub substantially stationary during the second washing cycle.

15. The washing machine of claim 11, wherein the fluid supplying device comprises a fluid pump.

* * * * *